US006364057B1

(12) United States Patent
Cornejo et al.

(10) Patent No.: US 6,364,057 B1
(45) Date of Patent: Apr. 2, 2002

(54) LADDER SHIELD FOR STEPLADDERS

(76) Inventors: Guy R. Cornejo; Carmen A. Cornejo, both of 30 Primero Rd., Los Lunas, NM (US) 87031

( * ) Notice: Subject to any disclaimer, the term of this patent is extended or adjusted under 35 U.S.C. 154(b) by 0 days.

(21) Appl. No.: 09/678,574

(22) Filed: Oct. 3, 2000

(51) Int. Cl.[7] ..... E06C 7/18; E04G 1/00; A47B 96/06

(52) U.S. Cl. ..... 182/106; 182/129; 248/210; 248/214; 248/231.81

(58) Field of Search ..... 182/129, 106; 248/210, 238, 211, 214, 231.81

(56) References Cited

U.S. PATENT DOCUMENTS

| | | | | | |
|---|---|---|---|---|---|
| 2,839,201 | A | * | 6/1958 | Auster | 248/231.81 X |
| 2,880,829 | A | * | 4/1959 | Watkins | 182/106 X |
| 3,293,602 | A | * | 12/1966 | Viviano | 182/186.1 |
| 3,311,195 | A | * | 3/1967 | Singer | 182/106 X |
| 3,814,364 | A | * | 6/1974 | Gargaro | 248/210 |
| 3,968,857 | A | | 7/1976 | Bryan | |
| 3,976,163 | A | * | 8/1976 | Watkinson | 182/129 X |
| 4,126,206 | A | | 11/1978 | Becnel | |
| 4,181,195 | A | | 1/1980 | Clarke | |
| 4,300,740 | A | * | 11/1981 | Killian | 182/129 X |
| 4,450,937 | A | * | 5/1984 | Broughton | 182/106 X |
| 4,579,197 | A | | 4/1986 | Spurling | |
| 4,726,446 | A | * | 2/1988 | Perbix | 182/129 X |
| 5,052,581 | A | * | 10/1991 | Christ et al. | 248/211 X |
| 5,282,519 | A | * | 2/1994 | Venturo et al. | 182/129 X |
| 5,421,428 | A | | 6/1995 | Ingles | |
| 5,441,126 | A | | 8/1995 | Orrick | |
| 5,649,623 | A | | 7/1997 | Kornblatt | |
| 5,682,960 | A | * | 11/1997 | Mobley et al. | 182/129 |
| 5,782,314 | A | * | 7/1998 | Zeitler | 182/129 |
| 5,950,972 | A | | 9/1999 | Irish | |

* cited by examiner

*Primary Examiner*—Daniel P. Stodola
*Assistant Examiner*—Hugh B. Thompson
(74) *Attorney, Agent, or Firm*—Dale J. Ream

(57) ABSTRACT

A ladder shield for use with a stepladder for blocking access to predetermined upper steps thereof comprises a first rectangular plate configured to lie flat atop the top step of a stepladder and a second rectangular plate depending from a front edge of the first plate. The second plate is integral to the first plate and extends downwardly from the first plate at the same angle as the legs supporting the steps of the stepladder so that the first and second plates are flush with the top step and step support legs, respectively. The ladder shield further includes a third plate hingedly coupled to a rear edge of the first plate for blocking access between the top step and an uppermost support strut on a second pair of support legs. The second and third plates include fasteners for removably coupling respective plates to a step and support strut, respectively. At least one fastener on the third plate defines an aperture for receiving a padlock so that the shield may be locked to the stepladder. The shield can only be removed by unlocking the third plate, pivoting the third plate outwardly, and then releasing the second plate from a respective step.

10 Claims, 8 Drawing Sheets

LADDER SHIELD FOR STEPLADDERS

BACKGROUND OF THE INVENTION

This invention relates generally to ladder access shields and, more particularly, to a ladder shield for use with a stepladder for blocking access to the uppermost steps thereof.

Ladders are an attractive nuisance to children who often attempt to climb them without the aid, assistance, or knowledge of an adult. This often results in injury. Accidents, however, also occur when adults incorrectly use a ladder. Users of stepladders frequently attempt to stand on the top step or the next highest step even when warning labels counsel against such usage. Users even climb up and stand on the support struts which extend between the secondary support legs of a stepladder. It can be appreciated that such usage frequently results in injury when a person loses his balance and falls from or with the stepladder.

Many ladder shielding devices have been proposed in the prior art. Although assumably effective for their intended purposes, existing devices do not adequately address the problem of a user standing on the top step or next highest step of a stepladder. More particularly, existing devices do not block the top step and next adjacent step of a stepladder from access by a user.

Therefore, it is desirable to have a ladder shield which completely blocks access to the top step and next highest step of a step ladder. Further, it is desirable to have a ladder shield which blocks access to the uppermost support strut of a stepladder.

SUMMARY OF THE INVENTION

A ladder shield according to the present invention is constructed for use with a conventional stepladder having a first pair of support legs with a plurality of steps disposed therebetween and a second pair of support legs having a plurality of support struts therebetween. The ladder shield includes a first plate having a rectangular configuration suitable to lie flat upon the top step of a conventional stepladder. The ladder shield further includes a second plate having a rectangular configuration that integrally depends from a front edge of the first plate. The second plate extends downwardly from the first plate at an obtuse angle that is substantially similar to the angle defined between the top step and first pair of support legs of a conventional stepladder. Therefore, the first and second plates may be mounted flush against the top step and the first pair of support legs of a stepladder. The second plate includes length and width dimensions sufficient to completely block access to the step adjacent the top step of the stepladder as well as the space between those steps. The second plate includes a pair of brackets for removably fastening the second plate to the step adjacent the top step.

The ladder shield may also include a third plate that is hingedly coupled to a rear edge of the first plate. The third plate includes a pair of clips for removably fastening the third plate to the uppermost support strut extending between the second pair of legs. One of the clips defines an aperture for receiving a padlock such that the ladder shield may be lockingly coupled to the stepladder. With both the second and third plates fastened to the stepladder, the shield can only be removed by first unlocking and unfastening the third plate, pivoting the third plate outwardly from the ladder, and then unfastening the second plate from the step.

Therefore, a general object of this invention is to provide a ladder shield which blocks access to the top step and the next adjacent step of a stepladder.

Another object of this invention is to provide a ladder shield, as aforesaid, which is simple and economical to construct and is easy to mount to and remove from a stepladder.

Still another object of this invention is to provide a ladder shield, as aforesaid, that is collapsible and portable.

A further object of this invention is to provide a ladder shield, as aforesaid, which may be locked to a stepladder in a mounted configuration.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
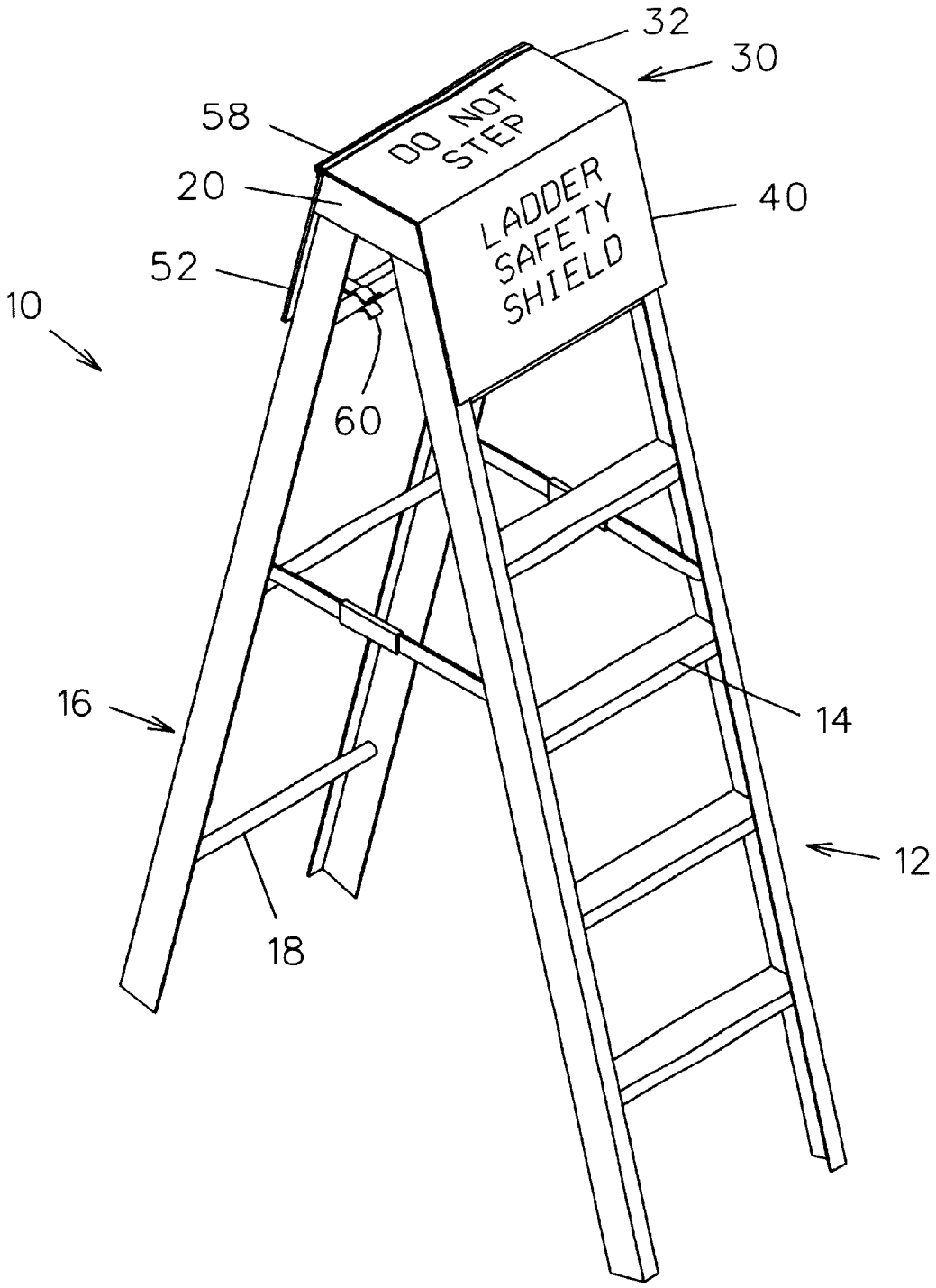
FIG. 1 is a perspective view of a ladder shield coupled to a stepladder according to an embodiment of the present invention.

A ladder shield 30 for use with a stepladder according to the present invention will now be described with reference to FIGS. 1–8 of the accompanying drawings. The ladder shield 30 is constructed for use with a conventional stepladder 10 having a first pair of support legs 12 with a plurality of steps 14 disposed therebetween in a spaced apart relationship parallel to one another and a second pair of support legs 16 with a plurality of support struts 18 extending therebetween in parallel spaced relation (FIG. 1). The ladder shield 30 includes a first plate 32 having a generally rectangular configuration with length and width dimensions substantially similar to those of a top step 20 of the stepladder 10. The first plate 32 includes indicia 34 such as "DO NOT STEP" which advises a user not to attempt to stand thereon. The first plate 32 as well as other plates to be further described below are constructed of sheet metal although fiberglass, Plexiglas®, or a lexan material would also be suitable.

Figure 2:
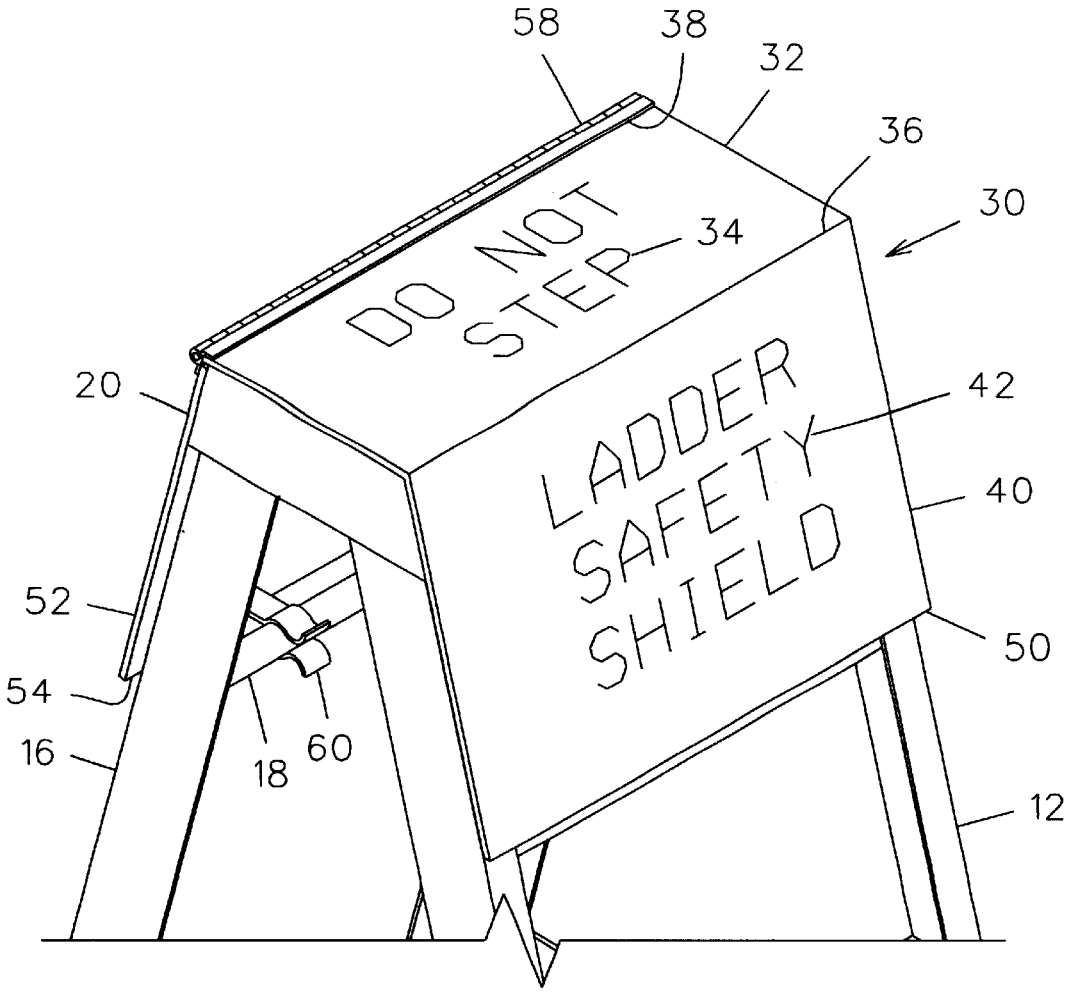
FIG. 2 is a fragmentary perspective view of the ladder shield as in FIG. 1 on an enlarged scale.

A second plate 40 having a generally rectangular configuration depends from a front edge 36 of the first plate 32 and is integrally attached thereto (FIG. 2). The second plate 40 extends downwardly from the front edge 36 of the first plate 32 at an obtuse angle relative to the first plate 32. The angular relationship between the first and second plates is substantially similar to the angle defined between the top step 20 and first pair of support legs 12 of the stepladder 10 such that the first and second plates 32, 40 may rest in flush engagement thereupon when positioned atop the stepladder 10 (FIG. 2). The second plate 40 includes a length and width dimension sufficient to completely block access to the step adjacent the top step 20 as well as the space between those steps. The second plate 40 also includes indicia 56 such as "Ladder Safety Shield" or other suitable phrase which indicates the reason why the top steps are blocked.

Figure 5:
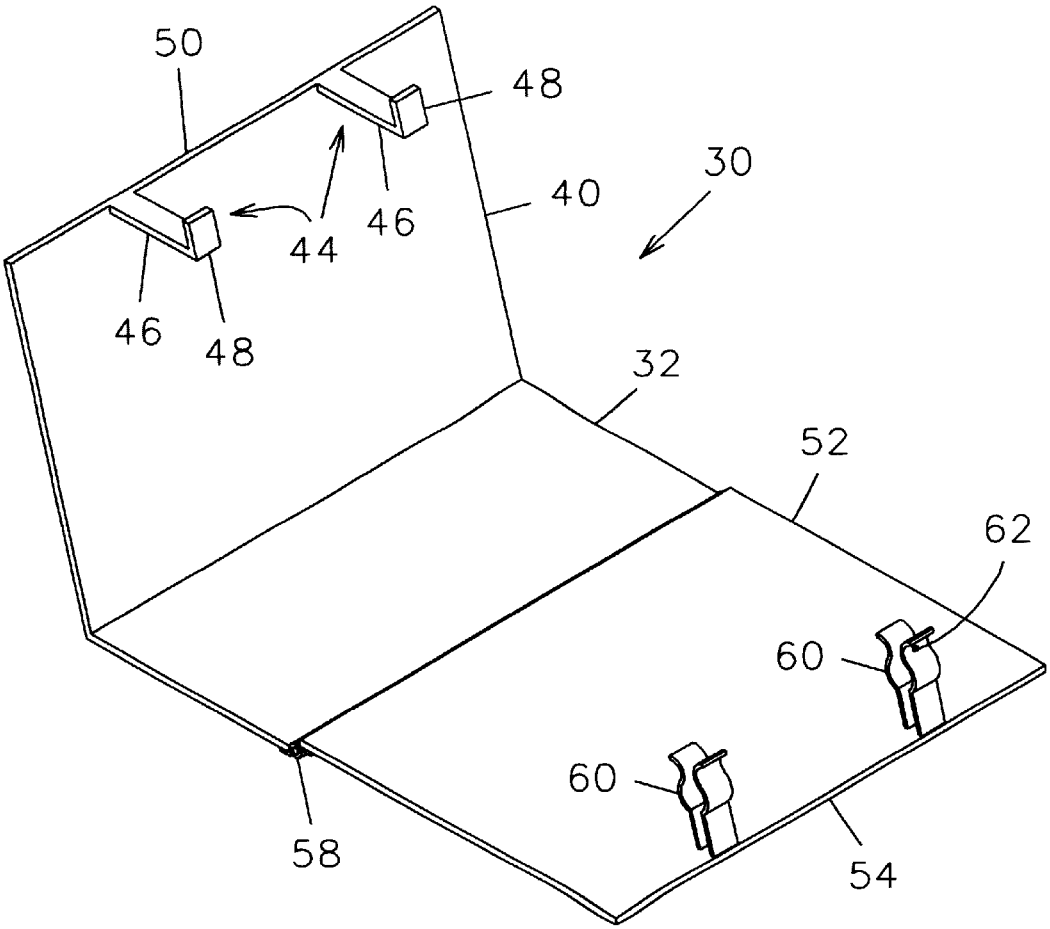
FIG. 5 is a bottom perspective view of the ladder shield removed from the stepladder and with the third plate pivoted about a hinge.

As best shown in FIG. 5, a pair of elongate hanging brackets 44 are fixedly attached to an inner face of the second plate 40 adjacent a free edge 50 thereof. Although the brackets 44 include arms 46 that are generally normal to the second plate 40, they may be slightly angled so as to rest flush upon the step adjacent the top step 20 when the shield 30 is mounted to a stepladder 10. Each bracket 44 includes a flange 48 that is normal and integral to a free end of a respective arm 46 for gripping the inner edge of a step and maintaining the shield's position upon the stepladder 10.

Figure 3:
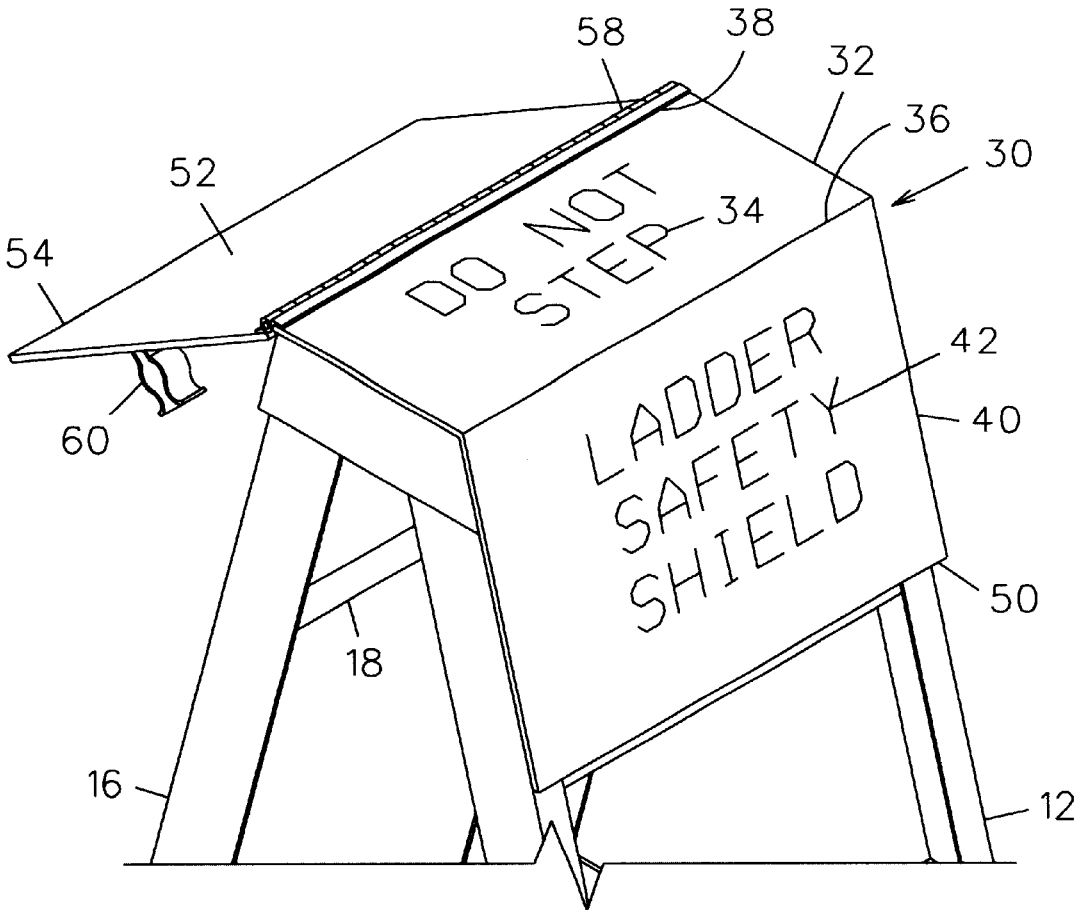
FIG. 3 is a fragmentary view as in FIG. 2 with the third plate pivoted outwardly from the stepladder.
Figure 4:
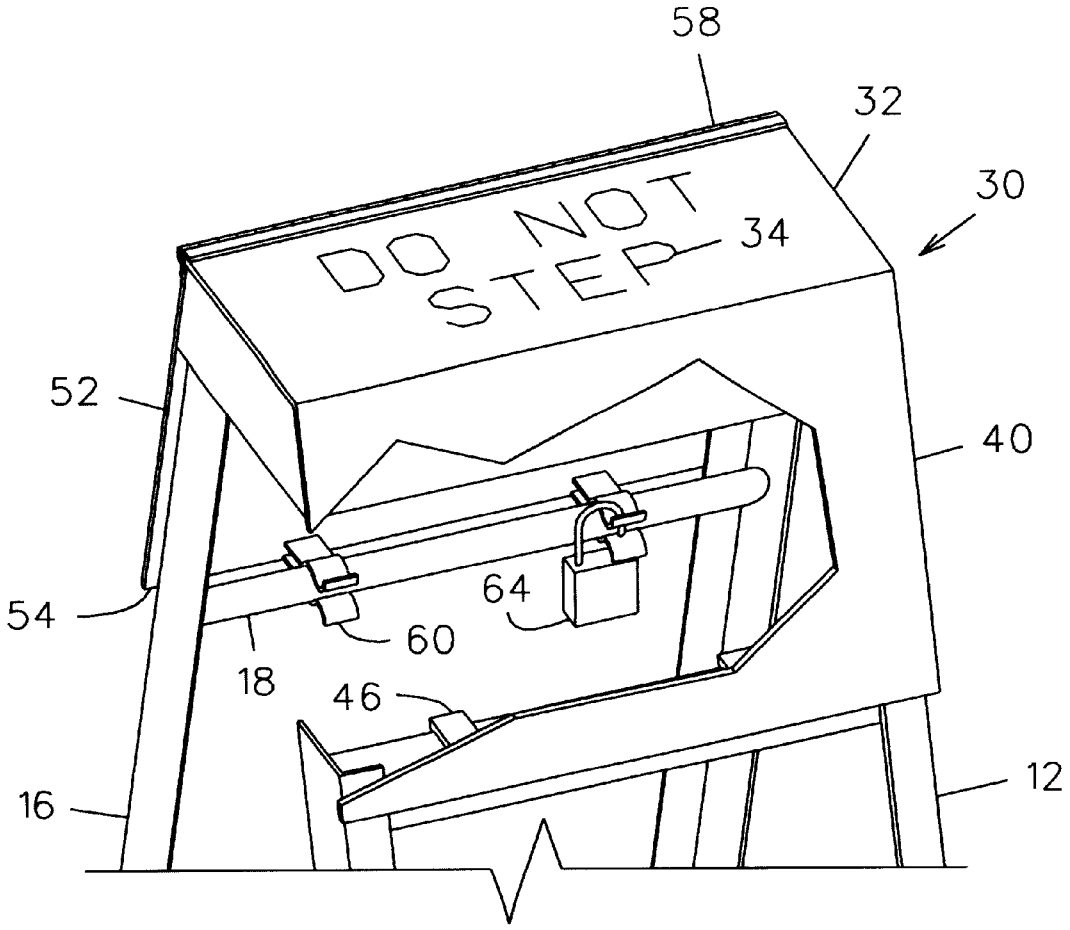
FIG. 4 is a fragmentary view as in FIG. 2 with a portion of the second plate cut away.

The ladder shield 30 further includes a third plate 52 having a generally rectangular configuration. The third plate 52 is pivotally coupled to a rear edge 38 of the first plate 32 with a hinge 58 (FIGS. 2 and 3). A pair of S-shaped pinch clips 60, also referred to as universal clamps, are fixedly attached to an inner face of the third plate 52 adjacent a free edge 54 thereof (FIGS. 4 and 5). Each clip 60 includes a pair of prongs configured to receive a support strut 18 therebetween and, therefore, to removably coupled the third plate 52 to the stepladder 10. It is understood that the prongs of each clip 60 may be constructed of spring steel or other resilient metal which frictionally grip a support strut 18 inserted therebetween. Both prongs of at least one of the pinch clips 60 define corresponding apertures 62 adjacent free ends thereof for receiving the locking element of a padlock 64 therethrough (FIGS. 4 and 5). Therefore, the ladder shield 30 cannot be removed from the stepladder 10 when the clips 60 are engaged with a strut 18 and the padlock 64 is in a locked configuration.

In use, the ladder shield 30 may be mounted to a conventional stepladder 10 by first resting the first plate 32 upon the top step 20 thereof. As the second plate 40 is integral to the first plate, it extends downwardly to cover the space between the top step 20 and the immediately adjacent step. The brackets 44 extending from the inner face of the second plate 40 come to rest upon the adjacent step as well. The third plate 52 may be pivoted outwardly while the first and second plates are being positioned. Then, the third plate 52 may be pivoted toward the stepladder 10 until the pinch clips 60 engage a support strut 18. A padlock 64 may then be coupled to a clip 60 so as to lock the shield 30 to the stepladder 10. Removal of the shield 30 is accomplished by reversing these steps.

Figure 6:
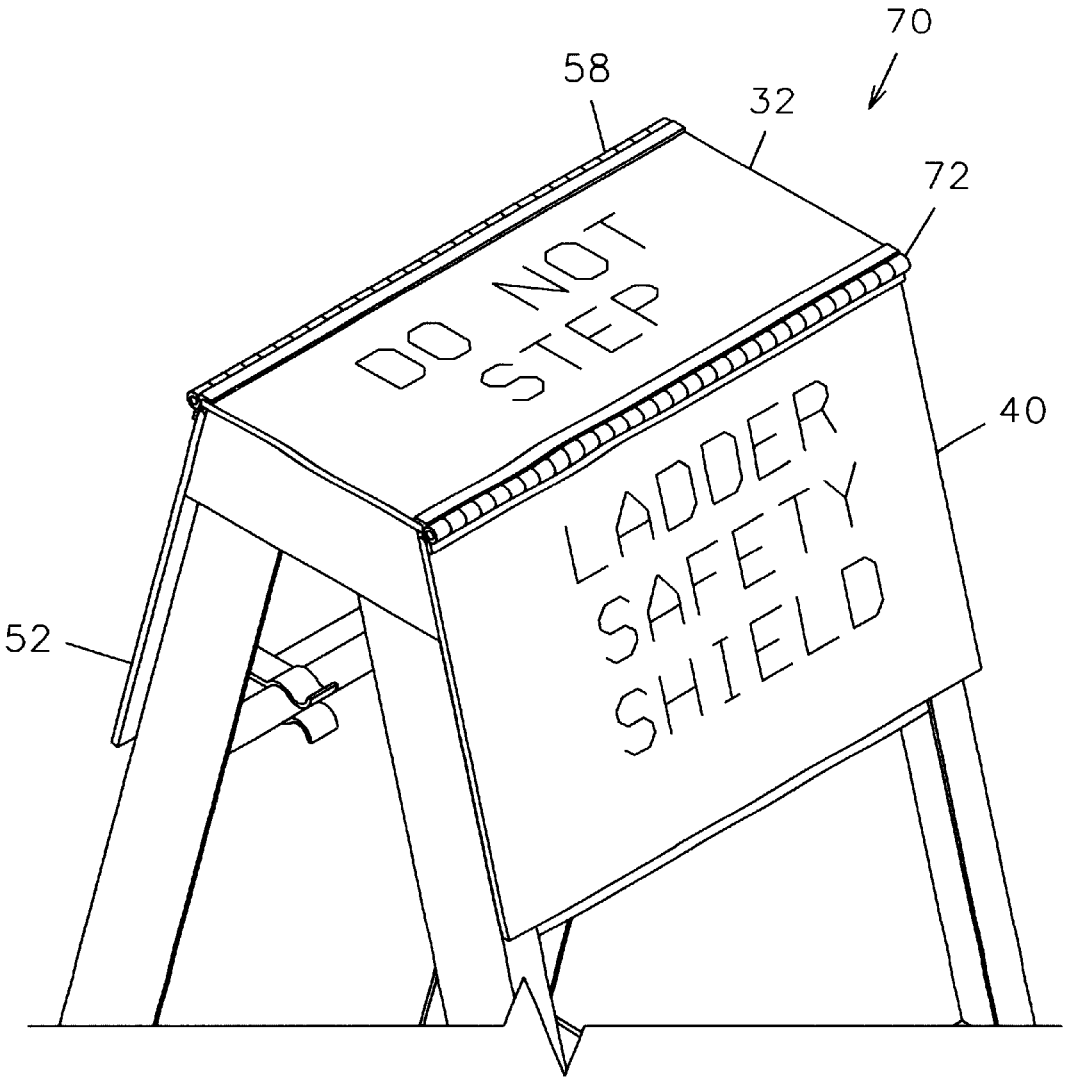
FIG. 6 is a fragmentary perspective view on an enlarged scale of a ladder shield coupled to a stepladder according to another embodiment of the present invention.
Figure 7:
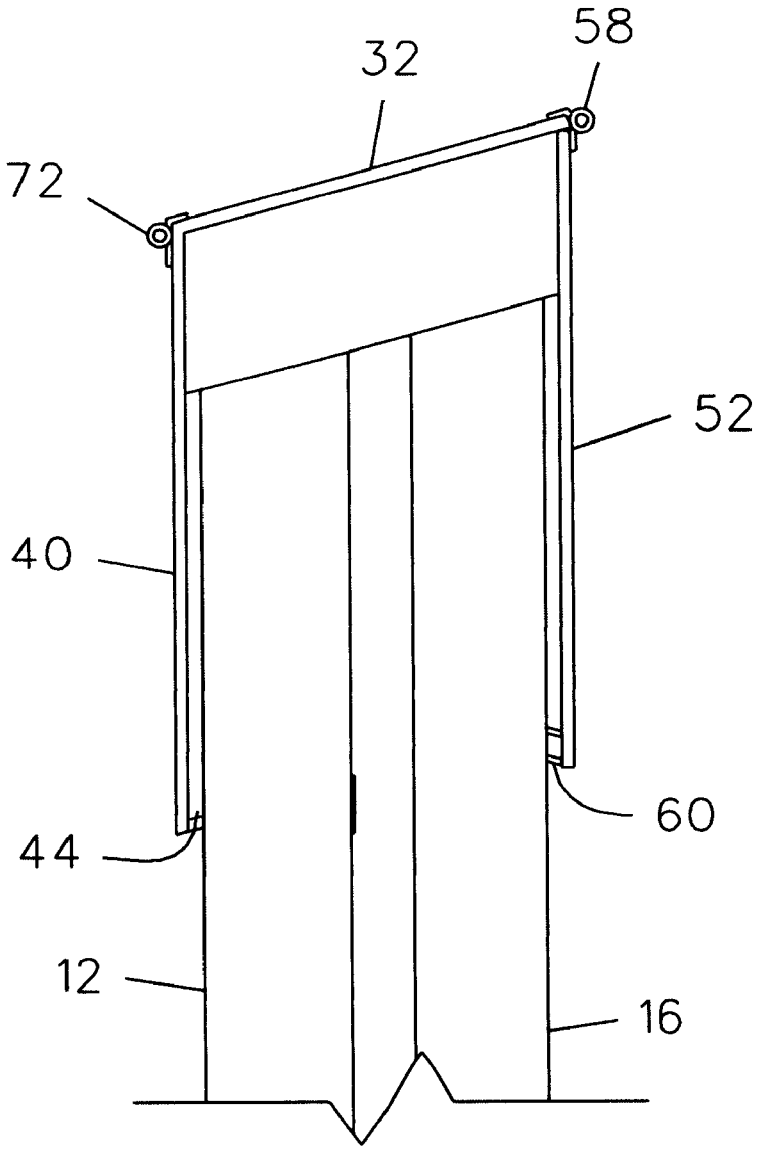
FIG. 7 is a side view of the ladder shield as in FIG. 6 with the stepladder in a folded configuration.

A ladder shield 70 according to another embodiment of this invention is shown in FIGS. 6 and 7 and is constructed in a manner substantially similar to the embodiment described previously except as specifically noted below. In this embodiment, the second plate 40 is pivotally coupled to the first plate with a hinge 72 for ease in mounting the shield to a stepladder, especially stepladders having non-conventional dimensions.

Figure 8:
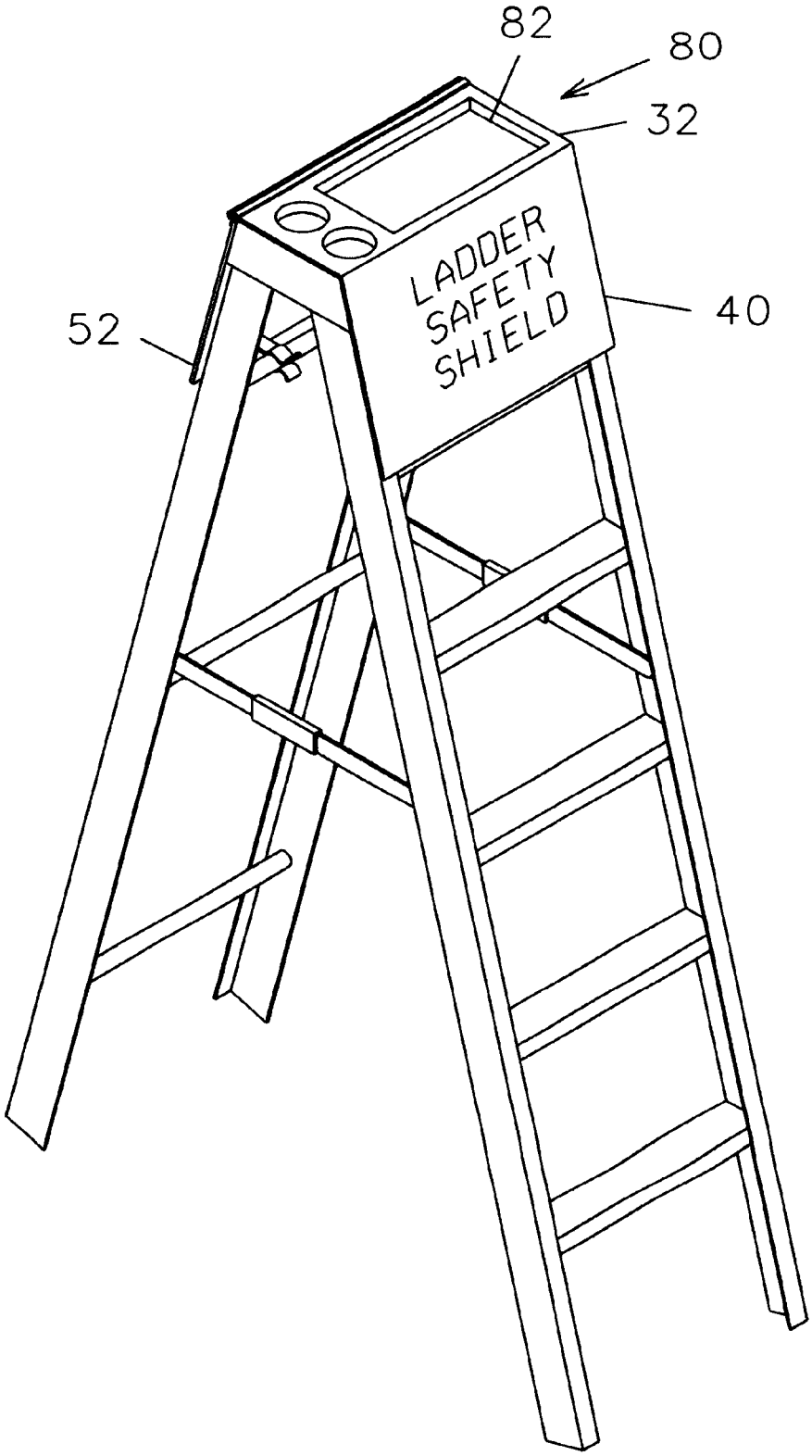
FIG. 8 is a perspective view of a ladder shield coupled to a stepladder according to another embodiment of the present invention.

A ladder shield 80 according to still another embodiment is shown in FIG. 8 and is constructed in a manner substantially similar to that described previously except as specifically noted below. In this embodiment, the first plate 32 includes a thickness and recesses 82 adapted to retain work pieces. Therefore, the first plate 32 is also useful as a work tray.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A ladder shield adapted for use with a stepladder for blocking access to upper steps thereof, said stepladder having a first pair of support legs with a plurality of steps disposed therebetween in a spaced apart relationship and a second pair of support legs having a plurality of support struts extending therebetween in a spaced apart relationship, said ladder shield comprising:

a first plate adapted to rest flat upon a top step of said stepladder, said first plate having a front edge and a rear edge;

a second plate depending from said front edge of said first plate and adapted to block access to a step of said stepladder adjacent said top step;

means for removably coupling said second plate to said step adjacent said top step;

a third plate hingedly coupled to said rear edge of said first plate and adapted to block access to an uppermost one of said support struts; and means for removably coupling said third plate to said uppermost support strut.

2. A ladder shield as in claim 1 further comprising means for locking said third plate to said uppermost support strut.

3. A ladder shield as in claim 1 wherein said second plate is fixedly attached to said first plate and defines an obtuse angle relative to said first plate, said first and second plates being adapted to be positioned flush against said top step and said first pair of support legs, respectively.

4. A ladder shield as in claim 1 wherein said second plate is hingedly coupled to said front edge of said first plate for positioning said first and second plates flush against said top step and said first pair of support legs regardless of the configuration of said stepladder.

5. A ladder shield as in claim 1 wherein said first plate includes indicia intended to dissuade a user from stepping on said top step of said stepladder.

6. A ladder shield as in claim 1 wherein said first plate defines a plurality of recesses so as to provide a work tray when positioned atop said stepladder.

7. A ladder shield as in claim 1 wherein:

said means for coupling said second plate to said step adjacent said top step includes a pair of spaced apart brackets fixedly attached to said second plate adjacent a free edge thereof and adapted to grip an inner edge of said step adjacent said top step;

said means for coupling said third plate to said uppermost support strut includes a pair of spaced apart pinch clips fixedly attached to said third plate adjacent a free edge thereof and adapted to grip said uppermost support strut.

8. A ladder shield as in claim 1 wherein said first, second, and third plates are generally rectangular, said second plate having a length and width adapted to completely block access to the space between said top step and a next adjacent step of said stepladder, said third plate having a length and width adapted to completely block access to the space between said top step and said uppermost support strut of said stepladder.

9. A ladder shield for use with a stepladder for blocking access to upper steps thereof, said stepladder having a first pair of support legs with a plurality of steps disposed therebetween in a spaced apart relationship and a second pair of support legs having a plurality of support struts extending therebetween in a spaced apart relationship, said ladder shield comprising:

a first plate adapted to rest flat upon a top step of said stepladder, said first plate having a front edge and a rear edge;

a second plate depending from said front edge of said first plate at an angle generally equivalent to an angle defined between said top step and said first pair of support legs such that said first and second plates are adapted to be positioned flush against said top step and said first pair of support legs, respectively, whereby to block access to a step of said stepladder adjacent said top step;

at least one bracket fixedly attached to said second plate adjacent a free edge thereof and adapted to grip an inner edge of said step adjacent said top step;

a third plate hingedly coupled to said rear edge of said first plate and adapted to block access to an uppermost one of said support struts; and at least one dual-pronged S-shaped clip coupled to said third plate adjacent a free edge thereof and means for locking said at least one S-clip to said uppermost support strut.

10. A ladder shield as in claim 8, wherein said second plate is hingedly coupled to said front edge of said first plate.

* * * * *